US011005208B2

(12) United States Patent
Tanaka et al.

(10) Patent No.: US 11,005,208 B2
(45) Date of Patent: May 11, 2021

(54) CONNECTOR AND WIRE HARNESS

(71) Applicant: Yazaki Corporation, Tokyo (JP)

(72) Inventors: Yasuhiro Tanaka, Shizuoka (JP); Hiroki Kitagawa, Shizuoka (JP); Masanobu Higashitani, Shizuoka (JP); Kengo Machida, Shizuoka (JP); Maho Shinohara, Shizuoka (JP); Masatoshi Yamada, Shizuoka (JP); Toshiaki Nozawa, Shizuoka (JP); Noboru Hayasaka, Shizuoka (JP); Takeaki Kaneko, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/664,939

(22) Filed: Oct. 27, 2019

(65) Prior Publication Data

US 2020/0136296 A1 Apr. 30, 2020

(30) Foreign Application Priority Data

Oct. 29, 2018 (JP) ..... JP2018-202519

(51) Int. Cl.

| | |
|---|---|
| ***H01R 13/40*** | (2006.01) |
| ***H01R 13/422*** | (2006.01) |
| ***H01R 13/516*** | (2006.01) |
| ***H01R 13/58*** | (2006.01) |
| ***H01R 13/629*** | (2006.01) |
| ***H01R 25/00*** | (2006.01) |

(52) U.S. Cl.

CPC ..... *H01R 13/4223* (2013.01); *H01R 13/516* (2013.01); *H01R 13/582* (2013.01); *H01R 13/629* (2013.01); *H01R 25/003* (2013.01)

(58) Field of Classification Search

CPC ..... H01R 27/00; H01R 13/635; H01R 13/633

USPC ..... 439/668, 669, 188, 944, 80, 140, 141, 439/375

See application file for complete search history.

(56) References Cited

U.S. PATENT DOCUMENTS

| | | | | |
|---|---|---|---|---|
| 5,538,441 A * | 7/1996 | Paolucci | ..... | H01R 13/5208 439/587 |
| 6,702,614 B2 | 3/2004 | Nakamura et al. | | |
| 9,004,940 B2 * | 4/2015 | Hasebe | ..... | H01R 13/4223 439/595 |

FOREIGN PATENT DOCUMENTS

| | | |
|---|---|---|
| EP | 1 560 297 A1 | 8/2005 |
| JP | 2003-115345 A | 4/2003 |
| JP | 2013-254696 A | 12/2013 |

* cited by examiner

*Primary Examiner* — Phuong Chi Thi Nguyen

(74) *Attorney, Agent, or Firm* — Kenealy Vaidya LLP

(57) ABSTRACT

A connector applied to a wire harness includes: a housing main body including a housing space part for housing a terminal along an axial direction, and an insertion port provided at one side of the housing space part in the axial direction and into which a counterpart terminal connected to the terminal is inserted; a lance that faces the housing space part, that is elastically deformably supported by the housing main body in a cantilever manner, that extends toward the insertion port side along the axial direction, and that engages the terminal housed in the housing space part; and a regulating contact part that comes into contact with the lance and that regulates excessive displacement of the lance toward the housing space part side.

10 Claims, 6 Drawing Sheets

CONNECTOR AND WIRE HARNESS

CROSS-REFERENCE TO RELATED APPLICATION(S)

The present application claims priority to and incorporates by reference the entire contents of Japanese Patent Application No. 2018-202519 filed in Japan on Oct. 29, 2018.

BACKGROUND OF THE INVENTION

1. Field of the Invention

The present invention relates to a connector and a wire harness.

2. Description of the Related Art

For example, as a conventional connector applied to a wire harness of a vehicle and the like, Japanese Patent Application Laid-open No. 2013-254696 discloses a connector including a terminal fitting and a housing that houses and holds the terminal fitting. In the terminal fitting, the outer peripheral part is provided with a concave part that is recessed in a direction orthogonal to an insertion direction into the housing. The housing includes a terminal housing hole into which the terminal fitting is inserted, and a terminal engagement lance. The terminal engagement lance includes an elastic piece that extends along the terminal housing hole at a position that faces the terminal housing hole, and an engagement protrusion that is protrusively provided on a tip end of the elastic piece so as to project into the terminal housing hole. In the connector, when the insertion length of the terminal fitting into the terminal housing hole reaches a prescribed value, the engagement projection is engaged with the concave part. Consequently, the movement of the connector in a direction opposite to the insertion direction of the fitting terminal will be restricted.

For example, in the connector disclosed in the above Japanese Patent Application Laid-open No. 2013-254696, when a terminal fitting at the connection counterpart side is connected to the terminal fitting, by the force applied to the terminal fitting, the terminal engagement lance having been engaged with the terminal fitting sometimes tends to collapse inward with the terminal fitting. Even in such a case, the connector is desired to hold the terminal in a proper manner.

SUMMARY OF THE INVENTION

The present invention has been made in view of the above circumstances, and an object of the present invention is to provide a connector and a wire harness that can hold a terminal in a proper manner.

In order to solve the above mentioned problem and achieve the object, a connector according to one aspect of the present invention includes a housing main body that includes a housing space part for housing a terminal along an axial direction, and an insertion port that is provided at one side of the housing space part in the axial direction and into which a counterpart terminal connected to the terminal is inserted; a lance that faces the housing space part, that is elastically deformably supported by the housing main body in a cantilever manner, that extends toward a side of the insertion port along the axial direction, and that engages the terminal housed in the housing space part; and a regulating contact part that comes into contact with the lance and that regulates excessive displacement of the lance toward a side of the housing space part.

According to another aspect of the present invention, in the connector, it is preferable that the lance includes an engagement part to be engaged with the terminal, and the regulating contact part comes into contact with the lance at the side of the insertion port with respect to the engagement part in the axial direction.

According to still another aspect of the present invention, in the connector, it is preferable that the lance includes a rib part that comes into contact with the regulating contact part on an end part at the side of the insertion port in the axial direction.

According to still another aspect of the present invention, in the connector, it is preferable that the regulating contact part is integrally formed with the housing main body.

In order to achieve the object, a wire harness according to still another aspect of the present invention includes a wiring material having conductivity; and a connector electrically connected to the wiring material, wherein the connector includes a housing main body that includes a housing space part for housing a terminal electrically connected to the wiring material along an axial direction, and an insertion port provided at one side of the housing space part in the axial direction and into which a counterpart terminal connected to the terminal is inserted, a lance that faces the housing space part, that is elastically deformably supported by the housing main body in a cantilever manner, that extends toward a side of the insertion port along the axial direction, and that engages the terminal housed in the housing space part, and a regulating contact part that comes into contact with the lance and that regulates excessive displacement of the lance toward a side of the housing space part.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment according to the present invention will be described in detail with reference to the accompanying drawings. It is to be understood that this invention is not limited to the embodiment. Moreover, components in the following embodiment include components that can be easily replaced by those skilled in the art or components substantially the same as those components.

In the following FIG. 1, only a part of a plurality of wiring materials is illustrated by a two-dot chain line. In the other drawings, the wiring material is not illustrated. Moreover, in the following explanation, in a first direction, a second direction, and a third direction that intersect with each other, the first direction is referred to as an "axial direction X", the second direction is referred to as a "width direction Y", and the third direction is referred to as a "height direction Z". In this example, the axial direction X, the width direction Y, and the height direction Z are orthogonal with each other. Typically, the axial direction X is a direction along a connector fitting direction of a connector with respect to the connection counterpart. That is, the axial direction X is a direction along an insertion direction of a terminal with respect to a housing space part of the connector. Unless otherwise specified, the directions used in the following explanation indicate directions in a state when the units are assembled with one another.

Embodiment

Figure 1:
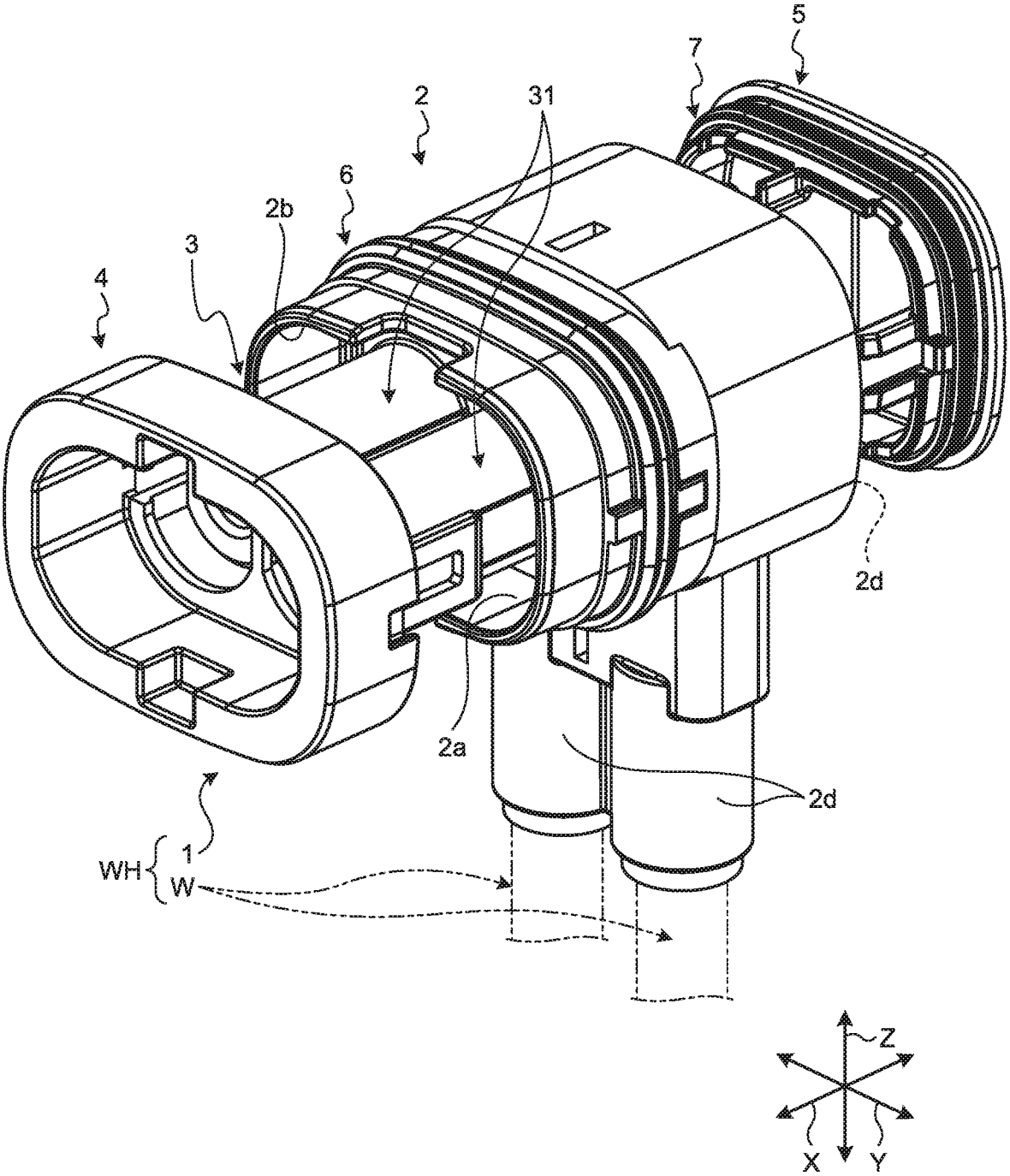
FIG. 1 is an exploded perspective view illustrating a schematic configuration of a connector according to an embodiment.

For example, a connector 1 according to the present embodiment illustrated in FIG. 1 is applied to a wire harness WH used for an automobile and the like. For example, to connect devices mounted on a vehicle, the wire harness WH forms a collective component by bundling a plurality of wiring materials W used for supplying electric power and signal communication, and connects the wiring materials W with the devices via a connector and the like. The wire harness WH includes the wiring material W having conductivity and the connector 1 electrically connected to the wiring material W. For example, the wiring material W includes an electric wire, an electric wire bundle, a metal rod, and the like. In the electric wire, the outside of a conductor part (core line) made of a plurality of conductive metal strands is covered by an insulating coating part. The electric wire bundle is obtained by bundling a plurality of the electric wires. In the metal rod, the outside of a conductive rod-like member is covered by an insulating coating part. In addition to the above, the wire harness WH may also include a grommet, a protector, a fixing tool, an electrical connection box, and the like.

Typically, the connector 1 in the present embodiment is connected to a device such as an inverter, and configures a device for wire-to-device connection that electrically connects the wiring material W with the connection counterpart. The connector 1 forms an electrically connected portion with the connection counterpart, by being fitted into a fitting hole formed on a housing of the connection counterpart and the like. More specifically, the connector 1 includes a housing 2, an inner housing 3, a front holder 4, a rear cover 5, and packings 6 and 7. The housing 2, the inner housing 3, the front holder 4, the rear cover 5, and the packings 6 and 7 are formed of a resin material having an insulation property. In the following explanation, in the connector 1, the connection counterpart side in the axial direction X may be referred to as a front side, and the side opposite to the axial direction X may be referred to as a rear side.

Figure 2:
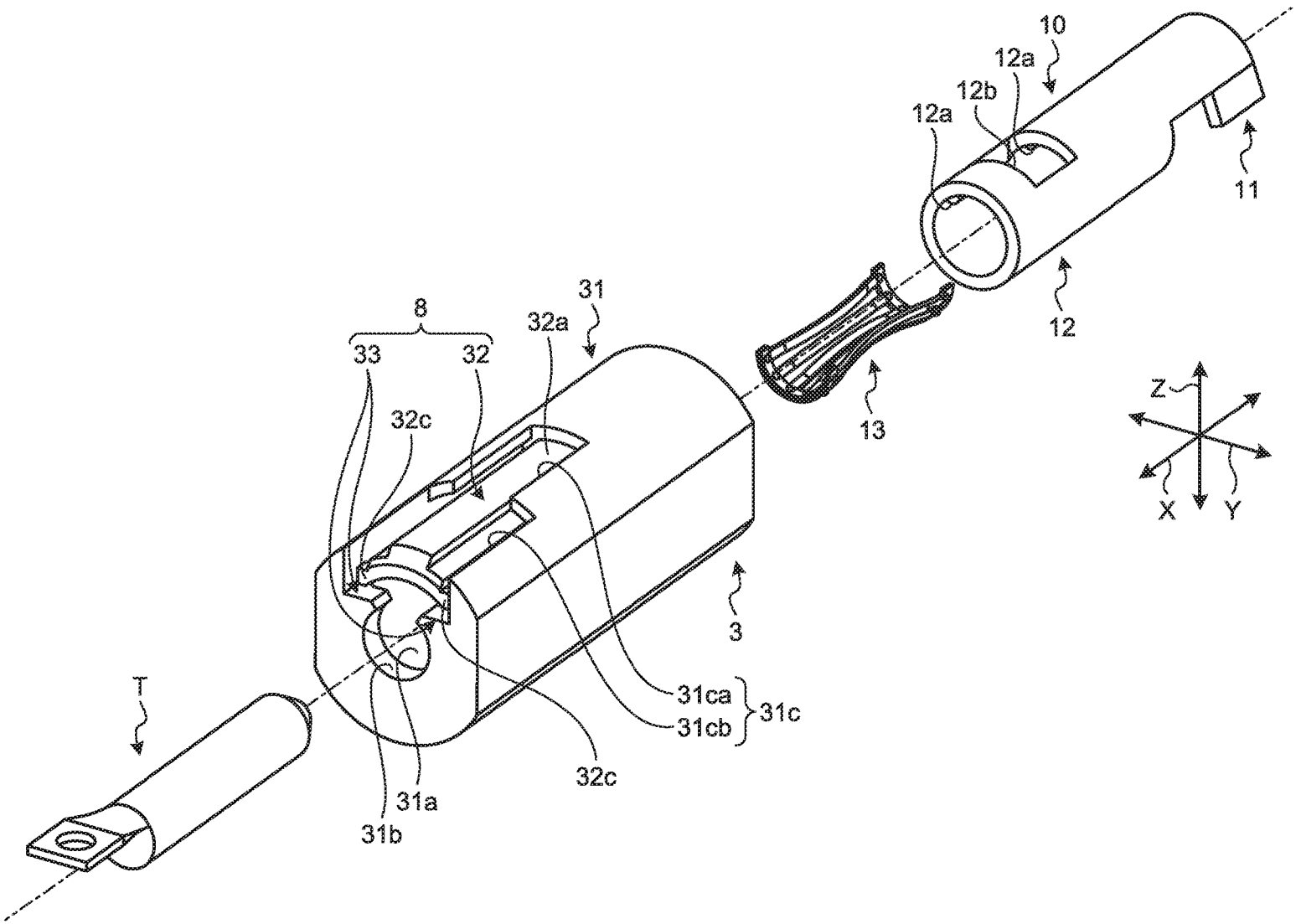
FIG. 2 is an exploded perspective view illustrating a schematic configuration of an inner housing of the connector according to the embodiment.
Figure 3:
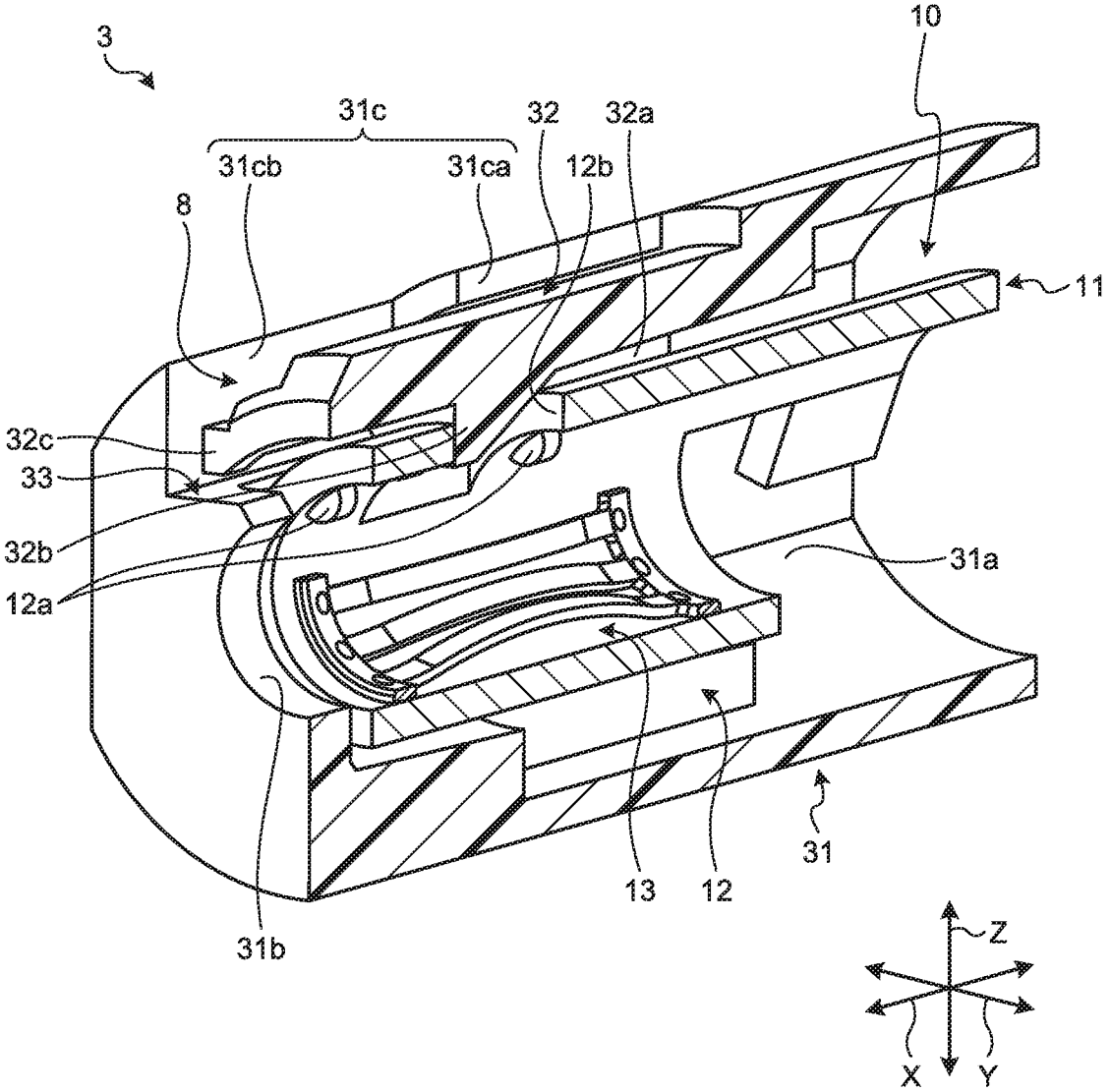
FIG. 3 is a sectional perspective view illustrating a schematic configuration of the inner housing of the connector according to the embodiment.

The housing 2 is a member that houses therein a terminal 10 (see FIG. 2) along the axial direction X. The housing 2 in the present embodiment houses and holds the terminal 10 along the axial direction X via the inner housing 3 provided in the housing 2. The housing 2 is formed in a substantially elongated cylindrical shape in which the center axis extends along the axial direction X and both end parts in the axial direction X are opened. The housing 2 houses the inner housing 3 in an inner space part 2*a*. The inner housing 3 is a member provided in the inner space part 2*a* of the housing 2, and houses and holds the terminal 10 along the axial direction X. In the housing 2, the front holder 4 is mounted on an opening part 2*b* of a front side end part in the axial direction X, with the packing 6 that is a water sealing member. The front holder 4 is a member that holds the inner housing 3 and the packing 6 between the housing 2 and the front holder 4 with respect to the axial direction X. In the inner space part 2*a*, the inner housing 3 is held between the housing 2 and the front holder 4 with respect to the axial direction X. While being held between the housing 2 and the front holder 4, a part of the inner housing 3 is exposed to the outside toward the front side in the axial direction X, via the opening part 2*b* at the front side end part of the housing 2 in the axial direction X, and the inside of the front holder. In the housing 2, the rear cover 5 is mounted on an opening part 2*c* of a rear side end part in the axial direction X, with the packing 7 that is a water sealing member. The rear cover 5 is a member assembled to the opening part 2*c* of the rear side end part of the housing 2 in the axial direction X with the packing 7. The rear cover 5 closes the opening part 2*c*. The wiring material W is inserted into the housing 2 via a wiring material insertion part 2*d*, along the height direction Z orthogonal to the axial direction X. In this example, two of the wiring materials W are inserted into the housing 2. For example, each of the wiring materials W inserted into the inner space part 2*a* via the wiring material insertion part 2*d* is electrically connected to the terminal 10 held in the inner housing 3 via a relay terminal, a relay bus bar, and the like.

In the configuration described above, as illustrated in FIG. 2, FIG. 3, FIG. 4, FIG. 5, and FIG. 6, the connector 1 in the present embodiment implements a configuration capable of holding the terminal 10 in a proper manner, by applying a terminal engaging structure 8 in which a regulating contact part 33 is provided in the inner housing 3. Hereinafter, configurations of the inner housing 3 will be described in detail with reference to the drawings.

More specifically, the inner housing 3 in the present embodiment includes a housing main body 31, a lance 32, and the regulating contact part 33. The housing main body 31, the lance 32, and the regulating contact part 33 are integrally formed of a resin material having an insulating property. The inner housing 3, the lance 32 and the regulating contact part 33 form the terminal engaging structure 8 that engages the terminal 10 held in the housing main body 31.

The terminal 10 held in the housing main body 31 is a metal fitting formed of a metal material having conductivity. The terminal 10 in the present embodiment is a female terminal electrically connected to a male counterpart terminal T. The terminal 10 includes a wiring material connection part 11 and a terminal connection part 12. In the terminal 10, the wiring material connection part 11 is placed at the rear side in the axial direction X, and the terminal connection part 12 is placed at the front side in the axial direction X. The wiring material connection part 11 and the terminal connection part 12 are integrally formed of a metal material having conductivity. The wiring material connection part 11 is a portion to which a terminal of the wiring material W is electrically connected. The wiring material connection part 11 includes a caulking piece (barrel) and the like. A conductor portion of the wiring material W is compressed to the wiring material connection part 11 by the caulking piece, thereby making the wiring material connection part 11 conductive. The terminal connection part 12 is a portion to which the counterpart terminal T is electrically connected. In the female terminal 10, the terminal connection part 12 is formed in a tubular shape. The counterpart terminal T in the present embodiment is formed in a substantially columnar shape. The terminal connection part 12 in the present embodiment is formed in a substantially cylindrical shape in accordance with the shape of the counterpart terminal T. Both end parts of the terminal connection part 12 in the axial direction X are opened. A plurality of indents 12*a* for securing contact points with the counterpart terminal T are formed on the inner peripheral surface side of the terminal connection part 12. Moreover, a spring member 13 is provided in the terminal connection part 12. The spring member 13 is an energizing member for applying load for securing vibration resistance to the counterpart terminal T. The spring member 13 applies a pressing load to the counterpart terminal T inserted into the terminal connection part 12 along the radial direction (height direction Z in FIG. 2). The counterpart terminal T is inserted into the terminal 10, from the opening at the front side of the terminal connection part 12 in the axial direction X. In the terminal 10, while securing the vibration resistance by the spring member 13, an electrically connected portion is formed between the terminal 10 and the counterpart terminal T via the indents 12*a*. In the terminal 10, as a structure to be engaged with the housing main body 31 via the lance 32, an engagement groove 12*b* is formed in the terminal connection part 12. The engagement groove 12*b* is a portion to be engaged with the lance 32. The engagement groove 12*b* penetrates through a wall body that forms the terminal connection part 12. In this example, in the terminal connection part 12, the engagement groove 12*b* is formed in a substantially rectangular shape on the wall body at a side that faces the spring member 13 along the radial direction (height direction Z in FIG. 2).

The inner housing 3 in the present embodiment holds two of the terminals 10 corresponding to two wiring materials W inserted into the inner space part 2*a*. The inner housing 3 includes two sets of the housing main body 31, the lance 32, and the regulating contact part 33 (see FIG. 1). In the inner housing 3, the two housing main bodies 31 are arranged side by side along the width direction Y, and the rear side end parts in the axial direction X are linked by a base part. In the inner space part 2*a* of the housing 2, the base part of the inner housing 3 is interposed and held between the housing 2 and the front holder 4. In the following FIG. 2, FIG. 3, FIG. 4, FIG. 5, and FIG. 6, the configuration of the two sets described above is substantially the same. Thus, one of the two sets is mainly described, and illustration and explanation of the other set will be omitted as much as possible.

The housing main body 31 is a main portion that houses and holds the terminal 10 along the axial direction X. The housing main body 31 includes a housing space part 31*a* and an insertion port 31*b*. The housing main body 31 is formed in a tubular shape, and the inner space part of which forms the housing space part 31*a*. The housing main body 31 in the present embodiment is formed in a substantially cylindrical shape in which the center axis extends along the axial direction X, in accordance with the shape of the terminal 10. The housing space part 31*a* is formed as a space part having a substantially columnar shape in which the center axis extends along the axial direction X. The housing space part 31*a* is also a space part that configures a terminal insertion chamber (cavity) into which the terminal 10 is inserted along the axial direction X. The housing space part 31*a* houses and holds the terminal 10 along the axial direction X. Both end parts of the housing main body 31 in the axial direction X are opened. In the housing main body 31, the terminal 10 is inserted into the housing space part 31*a* via the opening formed at the rear side end part in the axial direction X. In the housing main body 31, the opening formed at the front side end part in the axial direction X forms the insertion port 31*b*. The insertion port 31*b* is an opening provided at one side of the housing space part 31*a* in the axial direction X, in other words, at the front side, and into which the counterpart terminal T is inserted.

The housing main body 31 in the present embodiment includes a notch part 31*c* provided with the lance 32. The notch part 31*c* is formed in a slit shape on the wall body that forms the housing main body 31 along the axial direction X. The notch part 31*c* is provided on the wall body at one side of the housing main body 31 in the height direction Z, and penetrates through the wall body along the height direction Z. In the notch part 31*c*, a narrow part 31*ca* is formed at the rear side in the axial direction X, and a wide part 31*cb* is formed at the front side in the axial direction X. In the notch part 31*c*, the narrow part 31*ca* is a portion in which the width along the width direction Y is relatively narrow. In the notch part 31*c*, the wide part 31*cb* is a portion in which the width along the width direction Y is relatively wide. The front side end part of the wide part 31*cb* in the axial direction X communicates with the insertion port 31*b*.

The lance 32 is a portion that engages the terminal 10 housed in the housing space part 31*a*. The lance 32 faces the housing space part 31*a*, is elastically deformably supported by the housing main body 31 in a cantilever manner, and extends toward the insertion port 31*b* side along the axial direction X. More particularly, the lance 32 includes an arm part 32*a* and an engagement part 32*b*.

The arm part 32*a* is placed inside the notch part 31*c* of the housing main body 31, and extends along the axial direction X. The arm part 32*a* is projected in an arm shape from the rear side end part of the notch part 31*c* in the housing main body 31 in the axial direction X, toward the front side (in other words, the insertion port 31*b* side) along the axial direction X. In other words, in the arm part 32*a*, a base end part that is the rear side end part in the axial direction X is supported by being fixed to the edge part of the notch part 31*c*, and a tip end part that is the front side end part in the axial direction X becomes a free end. Consequently, the arm part 32*a* is elastically deformably supported by the housing main body 31 in a cantilever manner along the height direction Z.

In the lance 32, the engagement part 32*b* is a portion to be engaged with the terminal 10. The engagement part 32*b* is projected from the surface at the housing space part 31*a* side of the arm part 32*a* toward the inside of the housing space part 31*a* in a claw-like manner. The engagement part 32*b* is formed at a position at the tip end part (front side end part) side with respect to the center of the arm part 32*a* in the axial direction X. In a state in which the terminal 10 housed in the housing space part 31*a* of the housing main body 31 is placed at a normal position that is designed and determined in advance, the engagement part 32*b* is placed in the engagement groove 12*b* of the terminal 10, and is to be engaged with the engagement groove 12*b*.

Figure 4:
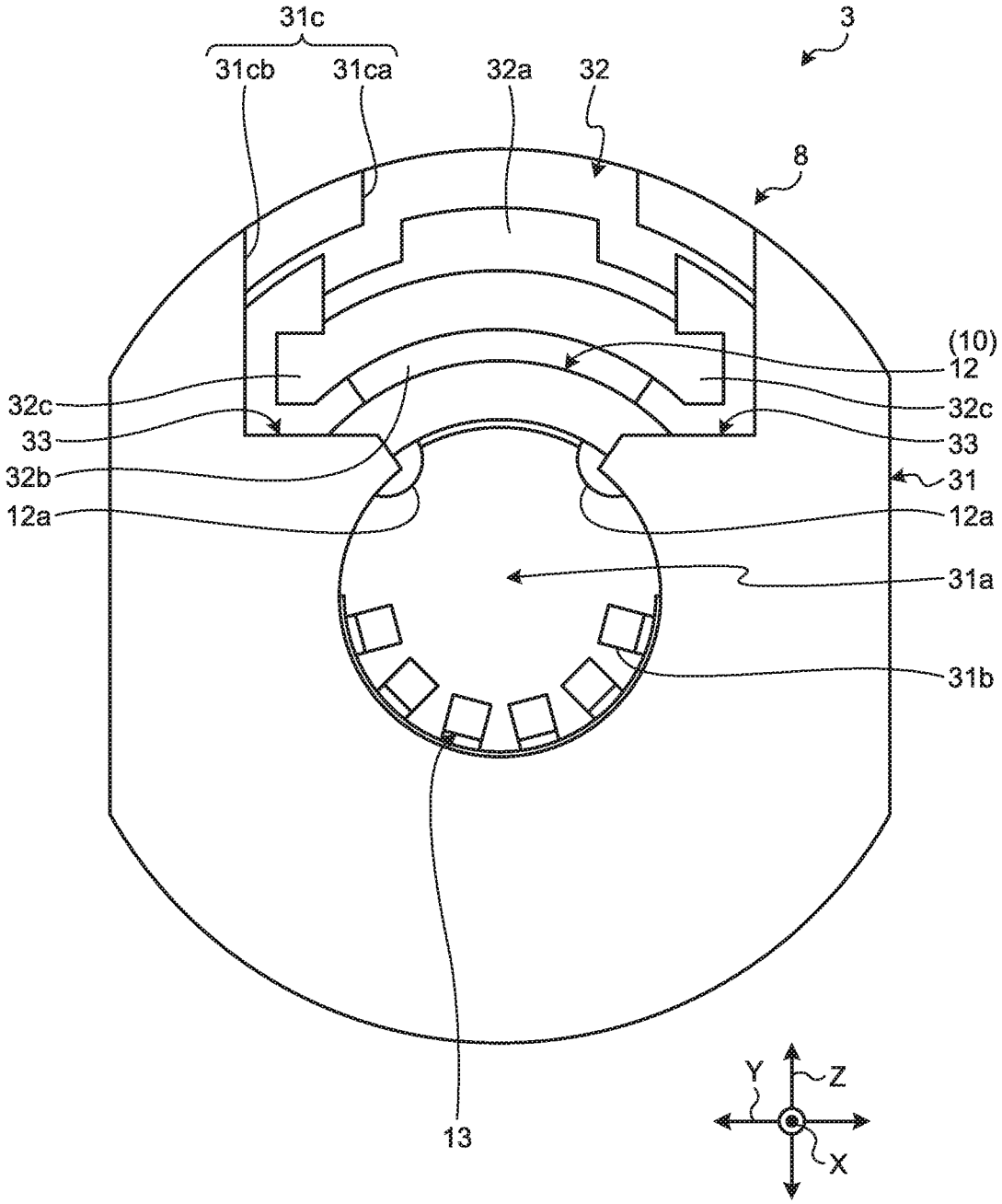
FIG. 4 is a front view illustrating a schematic configuration of the inner housing of the connector according to the embodiment.

In the lance 32 configured as above, with a movement of inserting and assembling the terminal 10 into the housing space part 31*a* along the axial direction X, the engagement part 32*b* moves into the engagement groove 12*b* at the normal position, while the entire lance 32 is bending in the width direction Y along the outer surface of the terminal connection part 12 of the terminal 10 (see FIG. 4). As a result, in the lance 32, the engagement part 32*b* is engaged with the front side edge part of the engagement groove 12*b* in the axial direction X, and the terminal 10 can be engaged at the normal position in the housing space part 31*a*.

Moreover, the lance 32 in the present embodiment includes a rib part 32*c*. The rib part 32*c* is a portion that comes into contact with the regulating contact part 33, when the regulating contact part 33 regulates the excessive displacement of the lance 32 toward the housing space part 31*a* side. The rib part 32*c* is also a portion that functions as a buckling prevention rib part. In this example, the excessive displacement of the lance 32 toward the housing space part 31*a* side corresponds to the excessive displacement of the terminal 10 in the engagement direction by the lance 32. The rib part 32*c* is formed on the tip end part of the arm part 32*a* of the lance 32 at the insertion port 31*b* side in the axial direction X (see FIG. 2, FIG. 3, FIG. 4, and the like). The rib part 32*c* is formed on both sides of the tip end part of the arm part 32*a* in the width direction Y. Each rib part 32*c* is formed so as to project from the tip end part of the arm part 32*a* toward the outer side (housing space part 31*a*) along the width direction Y. The rib part 32*c* is linearly extended along the axial direction X.

The regulating contact part 33 is a portion that comes into contact with the lance 32, and regulates the excessive displacement of the lance 32 toward the housing space part 31*a* side. The regulating contact part 33 in the present embodiment is integrally formed with the housing main body 31. In the housing main body 31, the regulating contact part 33 is formed on a communication portion between the wide part 31*cb* of the notch part 31*c* and the insertion port 31*b* (see FIG. 4 and the like). In total, two of the regulating contact parts 33 are provided on both sides of the communication portion in the width direction Y. By providing a step-shaped portion at both sides of the communication portion in the width direction Y, each of the regulating contact parts 33 is formed as a receiving surface for receiving the rib part 32*c*. The regulating contact part 33 formed as the receiving surface of the rib part 32*c* faces the rib part 32*c* along the height direction Z. In this example, the regulating contact part 33 is formed as a flat surface that extends along the width direction Y and that faces the rib part 32*c* side in the height direction Z.

The regulating contact parts 33 in the present embodiment regulates the excessive displacement of the lance 32 toward the housing space part 31*a* side, by coming into contact with the lance 32 at the insertion port 31*b* side (in other words, the tip end part side) with respect to the engagement part 32*b* in the axial direction X. In this example, more particularly, each of the regulating contact parts 33 regulates the excessive displacement of the lance 32 toward the housing space part 31*a* side, by coming into contact with the rib part 32*c* described above formed on the tip end part at the front side of the lance 32 in the axial direction X.

In the connector 1 and the wire harness WH described above, when the end part at the front holder 4 side of the housing 2 is fitted into the fitting hole of the connection counterpart and is connector joined, the terminal 10 and the counterpart terminal T are electrically connected, and an electrically connected portion is formed between the terminal 10 and the counterpart terminal T. Consequently, in the wire harness WH, the wiring material W and the connection counterpart are electrically connected via the connector 1.

In such a configuration, in the connector 1, the terminal 10 housed in the housing space part 31*a* of the housing main body 31 can be engaged by the lance 32. In this state, in the connector 1, with the fitting operation of the connection counterpart into the fitting hole, the counterpart terminal T inserted via the insertion port 31*b* of the housing main body 31 and the terminal 10 are connected.

Figure 5:
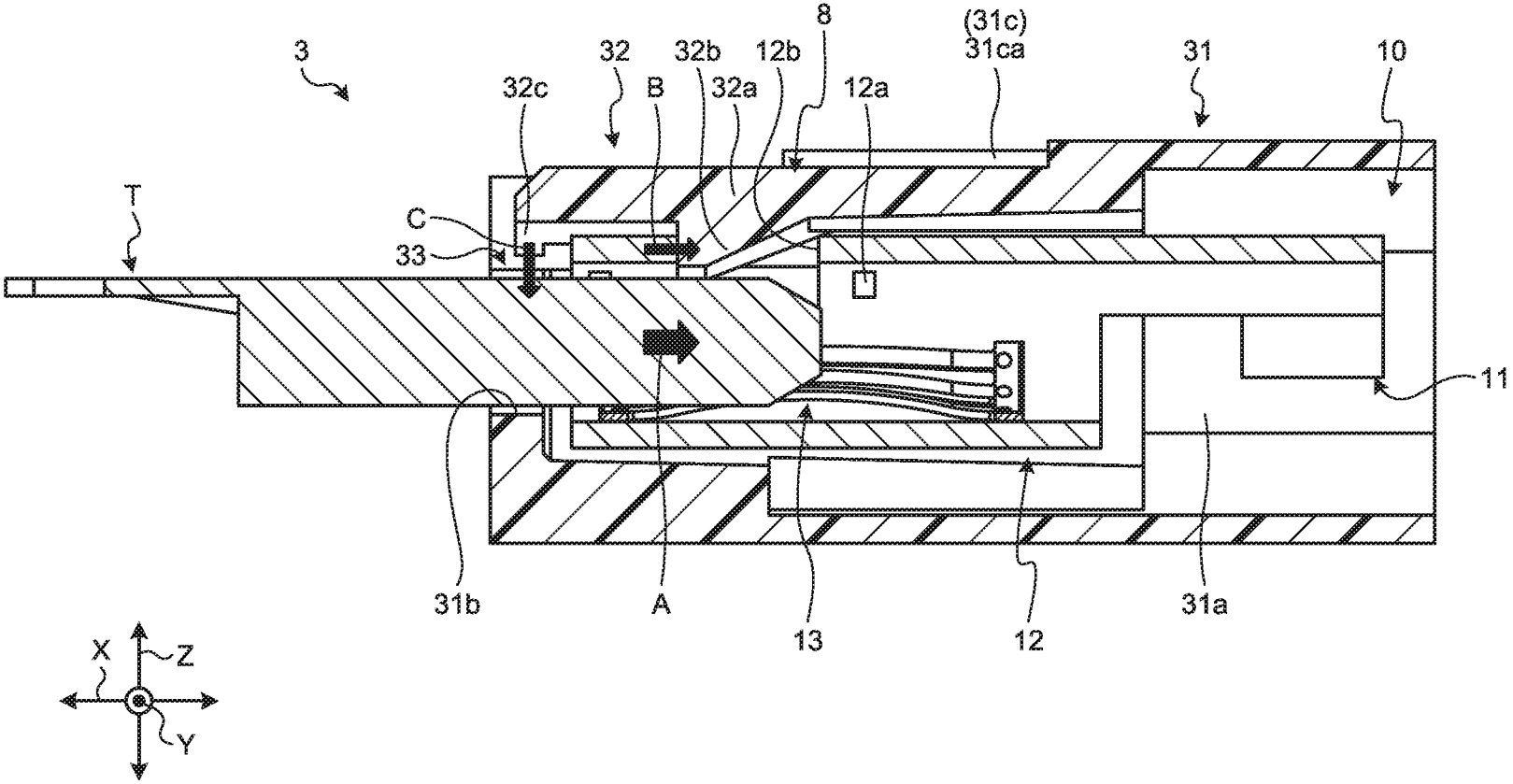
FIG. 5 is a sectional view illustrating a schematic configuration of the inner housing of the connector according to the embodiment along an axial direction.
Figure 6:
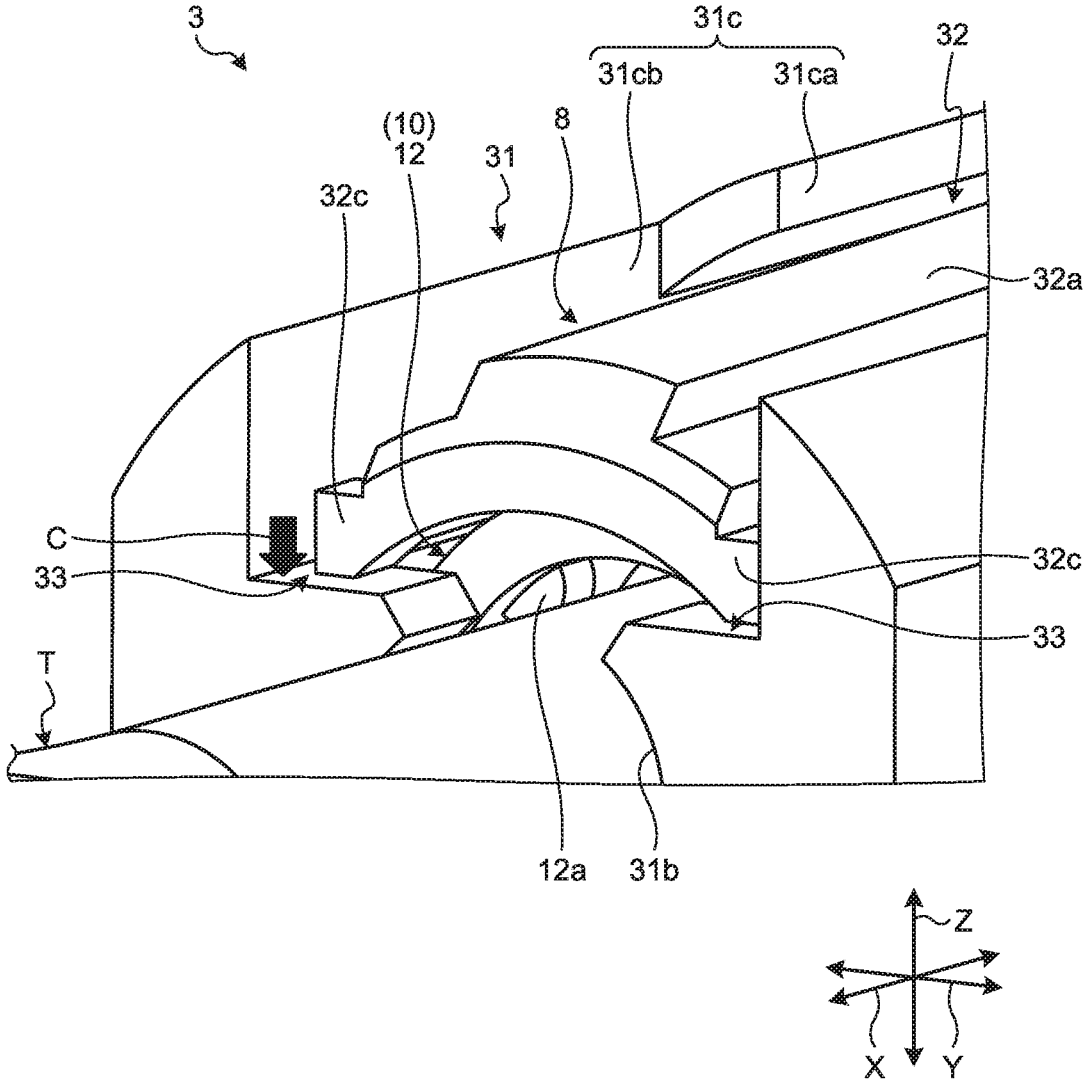
FIG. 6 is a partial perspective view including a regulating contact part of the inner housing of the connector according to the embodiment.

In this case, for example, in the connector 1, as illustrated in FIG. 5, when the counterpart terminal T is connected to the terminal 10 by inserting the counterpart terminal T in the arrow A direction along the axial direction X via the insertion port 31*b*, as illustrated by the arrow B in FIG. 5, force is applied to the terminal 10 from the counterpart terminal T caused by the insertion load generated when the counterpart terminal T is pressed in the arrow A direction. Then, in the connector 1, as illustrated by the arrow C in FIG. 5 and FIG. 6, by the force (arrow B) applied from the counterpart terminal T to the terminal 10, the lance 32 engaged with the terminal 10 tends to displace (deform) so as to collapse, while bending inward (housing space part 31*a*) with the terminal 10. In this case, in the connector 1, by bringing the regulating contact part 33 into contact with the lance 32, at a stage when the lance 32 is displaced as much as a clearance provided between the regulating contact part 33 and the lance 32, it is possible to regulate the excessive displacement of the lance 32 toward the housing space part 31*a* side (typically, large displacement such as to lower the function of the lance 32). With this configuration, in the connector 1, the state in which the terminal 10 is engaged with the housing space part 31*a* by the lance 32 can be maintained in a proper manner. Consequently, it is possible to maintain the state in which the terminal 10 is held by the housing space part 31*a* in a proper manner. As a result, the connector 1 and the wire harness WH can hold the terminal 10 in a proper manner.

In particular, the connector 1 in the present embodiment adopts a structure in which the vibration resistance is improved by applying load to the counterpart terminal T by the spring member 13 in the terminal 10. Consequently, the insertion load (arrow A) applied when the counterpart terminal T is inserted into the terminal connection part 12 of the terminal 10 tends to increase relatively. Thus, in the connector 1 in the present embodiment, the force (arrow B) applied from the counterpart terminal T to the terminal 10 caused by the insertion load of the counterpart terminal T also tend to increase relatively. Consequently, the force of the lance 32 to collapse inward with the terminal 10 also tends to increase relatively. However, in the connector 1 in the present embodiment, even if a relatively large force in the inward direction is applied to the lance 32 as described above, it is possible to regulate the excessive displacement of the lance 32 toward the housing space part 31*a* side without fail, by bringing the regulating contact part 33 into contact with the lance 32. As a result, the connector 1 in the present embodiment can more effectively exhibit the effect of holding the terminal 10 in a proper manner.

Moreover, in the connector 1 and the wire harness WH described above, the regulating contact part 33 comes into contact with the lance 32 at the insertion port 31*b* side (tip end part side) with respect to the engagement part 32*b*. Consequently, the regulating contact part 33 comes into contact with the lance 32 at a position relatively away from the base end part (support end part) of the lance 32. With this configuration, in the connector 1 and the wire harness WH, it is possible to suppress the displacement amount of the lance 32 to collapse inward to a relatively smaller amount. Consequently, it is possible to hold the terminal 10 in a more proper manner.

In this example, in the connector 1 and the wire harness WH described above, the lance 32 includes the rib part 32*c* that comes into contact with the regulating contact part 33 at the tip end part of the insertion port 31*b* side in the axial direction X. With this configuration, the connector 1 and the wire harness WH can bring the regulating contact part 33 into contact with the lance 32 without fail by the rib part 32*c*, and suppress the displacement amount of the lance 32 to collapse inward as small as possible. Consequently, it is possible to hold the terminal 10 in a more proper manner.

Moreover, in the connector 1 and the wire harness WH described above, the regulating contact part 33 is integrally formed with the housing main body 31. Consequently, it is possible to hold the terminal 10 in a proper manner as described above, while preventing the number of parts from increasing.

The connector and the wire harness according to the embodiment of the present invention described above are not limited to those in the embodiment described above, and various modifications may be made within the scope described in the claims.

In the above description, the regulating contact part 33 is integrally formed with the housing main body 31. However, it is not limited thereto. The regulating contact part 33 may also be formed separate from the housing main body 31, and provided on a member (for example, what is called a front holder and the like) assembled to the housing main body 31.

In the above description, the terminal connection part 12 is formed in a substantially cylindrical shape in accordance with the shape of the counterpart terminal T. However, it is not limited thereto, and the terminal connection part 12 may also be formed in a rectangular box shape and the like. In this case, the housing main body 31 and the housing space part 31*a* may also be formed in a rectangular box shape in response to the rectangular box shape of the terminal connection part 12. Moreover, when the counterpart terminal T is a female terminal, the terminal 10 is formed as a male terminal. In this case, the terminal connection part 12 is formed in a male tab shape.

In the above description, the regulating contact part 33 comes into contact with the rib part 32*c* to regulate the excessive displacement of the lance 32 toward the housing space part 31*a* side. However, it is not limited thereto. The lance 32 may not include the rib part 32*c*, and the regulating contact part 33 may come into contact with the lance 32 at any position, as long as the regulating contact part 33 can regulate the excessive displacement of the lance 32 toward the housing space part 31*a* side. For example, the regulating contact part 33 may also come into contact with the arm part 32*a* directly.

In the above description, in the connector 1, the terminal engaging structure 8 including the regulating contact part 33 is applied to the inner housing 3. However, it is not limited thereto. The connector 1 may not include the inner housing 3, the housing 2 may be used as the housing main body, and the terminal engaging structure 8 may be applied to the housing 2.

In the above description, the connector 1 may configure a connection mechanism for wire-to-wire connection that can electrically connect wiring materials.

In a connector and a wire harness according to the embodiment, the terminal housed in the housing space part of the housing main body can be engaged with the lance. In this state, in the connector, the counterpart terminal inserted via the insertion port of the housing main body and the terminal are connected. In this case, for example, in the connector, even when the lance having been engaged with the terminal is displaced so as to collapse inward with the terminal, by the force applied to the terminal when the counterpart terminal is to be connected, it is possible to regulate the excessive displacement of the lance toward the housing space part side by bringing the regulating contact part into contact with the lance. With this configuration, in the connector, the state in which the terminal is engaged with the housing space part by the lance can be maintained in a proper manner. Consequently, it is possible to maintain the state in which the terminal is held by the housing space part in a proper manner. As a result, the connector and the wire harness can exhibit advantageous effects of holding the terminal in a proper manner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector, comprising:

a terminal;

a housing main body that includes a housing space part housing the terminal along an axial direction, and an insertion port that is provided at one side of the housing space part in the axial direction and into which a counterpart terminal connected to the terminal is inserted;

a lance that faces the housing space part, that is elastically deformably supported by the housing main body in a cantilever manner, that extends toward a side of the insertion port along the axial direction, and that engages the terminal housed in the housing space part; and a regulating contact part that comes into contact with the lance and that regulates displacement of the lance toward the terminal, the regulating contact part is located directly between the lance and the counterpart terminal when the counterpart terminal is inserted into the terminal.

2. The connector according to claim 1, wherein the regulating contact part is integrally formed with the housing main body.

3. The connector according to claim 1, further comprising:

a spring in the housing space part opposing the lance, and wherein the counterpart terminal is located between the spring and the lance when the counterpart terminal is inserted into the terminal.

4. The connector according to claim 1, wherein the lance includes a rib part that comes into contact with the regulating contact part on an end part at the side of the insertion port in the axial direction.

5. The connector according to claim 4, wherein the regulating contact part is integrally formed with the housing main body.

6. The connector according to claim 1, wherein the lance includes an engagement part to be engaged with the terminal, wherein and the regulating contact part comes into contact with the lance at the side of the insertion port with respect to the engagement part in the axial direction.

7. The connector according to claim 6, wherein the lance includes a rib part that comes into contact with the regulating contact part on an end part at the side of the insertion port in the axial direction.

8. The connector according to claim 6, wherein the regulating contact part is integrally formed with the housing main body.

9. A wire harness, comprising:

a wiring material having conductivity; and a connector electrically connected to the wiring material, wherein the connector includes:

a terminal, a housing main body that includes a housing space part housing the terminal electrically connected to the wiring material along an axial direction, and an insertion port provided at one side of the housing space part in the axial direction and into which a counterpart terminal connected to the terminal is inserted, a lance that faces the housing space part, that is elastically deformably supported by the housing main body in a cantilever manner, that extends toward a side of the insertion port along the axial direction, and that engages the terminal housed in the housing space part, and a regulating contact part that comes into contact with the lance and that regulates displacement of the lance toward the terminal, the regulating contact part is located directly between the lance and the counterpart terminal when the counterpart terminal is inserted into the terminal.

10. A connector, comprising:

a terminal;

a housing main body that includes a housing space part housing the terminal along an axial direction, and an insertion port that is provided at one side of the housing space part in the axial direction and into which a counterpart terminal connected to the terminal is inserted;

a lance that faces the housing space part, that is elastically deformably supported by the housing main body in a cantilever manner, that extends toward a side of the insertion port along the axial direction, and that engages the terminal housed in the housing space part; and a regulating contact part that comes into contact with the lance and that regulates displacement of the lance toward the terminal; and a spring in the housing space part opposing the lance, wherein the counterpart terminal is located between the spring and the lance when the counterpart terminal is inserted into the terminal.

* * * * *